US011629678B2

(12) United States Patent
Miyamoto et al.

(10) Patent No.: US 11,629,678 B2
(45) Date of Patent: Apr. 18, 2023

(54) FUEL INJECTION VALVE AND METHOD FOR ASSEMBLING SAME

(71) Applicant: HITACHI AUTOMOTIVE SYSTEMS, LTD., Hitachinaka (JP)

(72) Inventors: Akiyasu Miyamoto, Hitachinaka (JP); Masashi Sugaya, Hitachinaka (JP); Yasuo Namaizawa, Hitachinaka (JP); Takuya Watai, Hitachinaka (JP)

(73) Assignee: HITACHI ASTEMO, LTD., Hitachinaka (JP)

( * ) Notice: Subject to any disclaimer, the term of this patent is extended or adjusted under 35 U.S.C. 154(b) by 164 days.

(21) Appl. No.: 16/971,081

(22) PCT Filed: Jan. 24, 2019

(86) PCT No.: PCT/JP2019/002180
§ 371 (c)(1),
(2) Date: Aug. 19, 2020

(87) PCT Pub. No.: WO2019/163383
PCT Pub. Date: Aug. 29, 2019

(65) Prior Publication Data

US 2021/0102520 A1 Apr. 8, 2021

(30) Foreign Application Priority Data

Feb. 23, 2018 (JP) ..... JP2018-031220

(51) Int. Cl.
*F02M 61/16* (2006.01)
*F02M 61/10* (2006.01)
(Continued)

(52) U.S. Cl.
CPC ..... *F02M 51/0671* (2013.01); *F02M 61/168* (2013.01); *F02M 61/10* (2013.01);
(Continued)

(58) Field of Classification Search
CPC ..... F02M 61/168; F02M 61/10; F02M 61/18; F02M 51/0671; F02M 51/0685;
(Continued)

(56) References Cited

U.S. PATENT DOCUMENTS 6,510,841 B1 * 1/2003 Stier ..... F02M 51/0685 123/472
8,528,842 B2 * 9/2013 Hoang ..... F02M 51/0685 123/498
(Continued)

FOREIGN PATENT DOCUMENTS

JP 2003-511604 A 3/2003
JP 2014-141924 A 8/2014
(Continued)

OTHER PUBLICATIONS

International Search Report with English translation and Written Opinion issued in corresponding application No. PCT/JP2019/002180 dated Apr. 23, 2019.

*Primary Examiner* — Christopher R Dandridge
(74) *Attorney, Agent, or Firm* — Foley & Lardner LLP

(57) ABSTRACT

Provided is a fuel injection valve capable of stroking a valve body in two stages of large and small strokes and improving responsiveness of a valve opening operation. Therefore, a first mover 201 is attracted to a magnetic core 107. A second mover 202 is formed separately from the first mover 201, and is attracted to the magnetic core 107 on an inner diameter side of the first mover 201. A valve body 101 has a flange portion 101*a* on an upstream side of the second mover 202. A spacer 213 forms a gap (void g1) in an axial direction between the flange portion 101*a* and the second mover 202 in a valve closed state.

14 Claims, 9 Drawing Sheets

(51) Int. Cl.
*F02M 51/06* (2006.01)
*F02M 61/18* (2006.01)

(52) U.S. Cl.
CPC ..... *F02M 61/18* (2013.01); *F02M 2200/50* (2013.01); *F02M 2200/8061* (2013.01)

(58) Field of Classification Search
CPC ..... F02M 51/066; F02M 63/0022; F02M 63/0075; F02M 61/12; F02M 2200/50; F02M 2200/8061
See application file for complete search history.

(56) References Cited

U.S. PATENT DOCUMENTS 9,903,327 B2 * 2/2018 Izzo ..... F02M 61/20
2009/0288640 A1 * 11/2009 Shingu ..... F02M 51/0671 123/472
2012/0080542 A1 * 4/2012 Imai ..... F02M 51/0671 239/533.2
2015/0354515 A1 12/2015 Yasukawa
2016/0097358 A1 * 4/2016 Miyake ..... F02M 51/061 239/585.1
2017/0218907 A1 8/2017 Matsukawa
2018/0163685 A1 6/2018 Yasukawa

FOREIGN PATENT DOCUMENTS

JP 2016-48064 A 4/2016
JP 2017-14921 A1 1/2017
JP WO2017002638 * 1/2017 ..... F02M 47/027

* cited by examiner (a) DRIVE CURRENT VALUE AND VALVE BODY DISPLACEMENT AT SMALL LIFT (b) DRIVE CURRENT VALUE AND VALVE BODY DISPLACEMENT AT LARGE LIFT

FUEL INJECTION VALVE AND METHOD FOR ASSEMBLING SAME

TECHNICAL FIELD

The present invention relates to a fuel injection valve and a method for assembling the same.

BACKGROUND ART

A fuel injection valve having a variable stroke mechanism is known as a background art of the present technical field (see, for example, PTL 1).

PTL 1 describes that "a slidable valve body, a first mover cooperating with the valve body, an internal fixed iron core provided at a position facing a second mover, an external fixed iron core, and a coil are provided, in which large and small lifts are generated by using a difference between magnetic attractive forces generated in the first mover and the second mover by a current to be supplied to the coil by setting the lift amount of the second mover to be larger than the lift amount of the first mover and projecting a part of the second mover toward the inside of the first mover."

CITATION LIST

Patent Literature

PTL 1: JP 2014-141924 A

SUMMARY OF INVENTION

Technical Problem

In the configuration disclosed in PTL 1, the valve body can be stroked in two stages of large and small strokes, but the improvement of the responsiveness of the valve opening operation is not examined.

An object of the present invention is to provide a fuel injection valve capable of stroking a valve body in two stages of large and small strokes and improving responsiveness of a valve opening operation.

Solution to Problem

In order to achieve the aforementioned object, the present invention provides a fuel injection valve including a first mover that is attracted to a magnetic core, a second mover that is formed separately from the first mover, and is attracted to the magnetic core on an inner diameter side of the first mover, a valve body that has a flange portion on an upstream side of the second mover, and a spacer that forms a gap in an axial direction between the flange portion and the second mover in a valve closed state.

Advantageous Effects of Invention

According to this invention, it is possible to stroke a valve body in two stages of large and small strokes, and it is possible to improve responsiveness of a valve opening operation. Other objects, configurations, and effects will be made apparent in the descriptions of the following embodiments.

DESCRIPTION OF EMBODIMENTS

Hereinafter, an embodiment of the present invention will be described with reference to the drawings.

Figure 1:
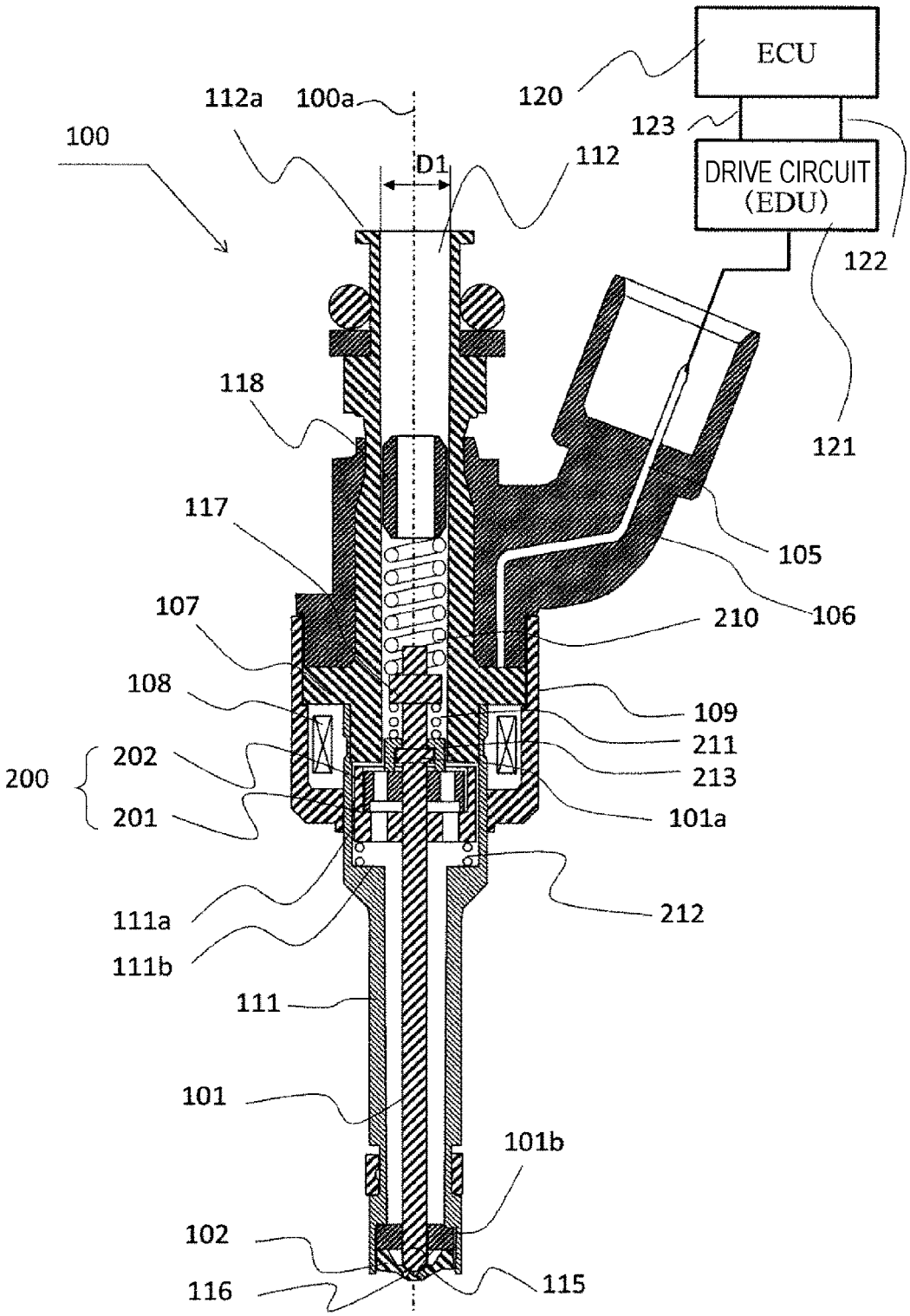
FIG. 1 is a cross-sectional view of a fuel injection valve according to an embodiment of the present invention.

A fuel injection valve according to the embodiment of the present invention will be described below with reference to FIGS. 1 to 4. FIG. 1 is a cross-sectional view of an electromagnetic fuel injection valve 100 (fuel injection device) of the present embodiment. FIG. 1 is a longitudinal sectional view of the fuel injection valve 100 and is a diagram illustrating an example of a configuration of an EDU 121 (drive circuit) and an ECU 120 (engine control unit) for driving the fuel injection valve 100.

The fuel injection valve 100 illustrated in FIG. 1 is an electromagnetic fuel injection valve for an in-cylinder direct injection type gasoline engine that directly injects fuel into an engine cylinder. The present invention is also applicable to an electromagnetic fuel injection valve for a port injection type gasoline engine that injects fuel into an intake pipe that supplies air into an engine cylinder. Of course, it is possible to apply the present invention to a fuel injection valve driven by a piezo element or a magnetostrictive element.

The EDU 121 is a drive device that generates a drive voltage for the fuel injection valve 100. The ECU 120 receives signals indicating states of an engine from various sensors, and calculates an appropriate drive pulse width and an appropriate injection timing according to an operating condition of an internal combustion engine. A drive pulse output from the ECU 120 is input to the EDU 121 via a signal line 123. The EDU 121 supplies a drive current by applying a command voltage to a coil 108 according to the drive pulse or the injection timing commanded by the ECU 120.

The ECU 120 communicates with the EDU 121 through a communication line 122, and can switch the drive current generated by the EDU 121 according to a pressure of the fuel to be supplied to the fuel injection valve 100 and an operating condition. The EDU 121 can change a control constant by communicating with the ECU 120, and a waveform of the drive current changes according to the control constant. Although it is described in FIG. 1 that the ECU 120 and the EDU 121 are separate units as the drive device, these units may be integrated.

First, an overall configuration and a flow of the fuel in the fuel injection valve 100 will be described. In the case of the electromagnetic fuel injection valve for an in-cylinder direct injection type gasoline engine, a metal pipe forming a fuel supply port 112 is attached to a common rail (not illustrated).

High-pressure fuel from a high-pressure fuel pump (not illustrated) is sent to the common rail, and the high-pressure fuel having a set pressure (for example, 35 MPa) stored in the common rail. The high-pressure fuel of the common rail is supplied into the fuel injection valve 100 via a fuel inlet surface 112*a* of the fuel supply port 112. In the description of the present embodiment, a side of the fuel injection valve 100 close to the fuel inlet surface 112*a* in an axial direction (an up-down direction of FIG. 1) will be described as an upstream side, and a side of the fuel injection valve close to a seat member 102 will be described as a downstream side. A direction from the fuel inlet surface 112*a* toward the seat member 102 will be referred to as a downstream direction, and an opposite direction thereof will be referred to as an upstream direction.

The fuel injection valve 100 includes a nozzle holder 111, and has a valve body 101 that opens and closes a flow path inside. The nozzle holder 111 holds a cylindrical seat member 102 at a position facing a downstream end portion of the valve body 101. In the seat member 102, a seat portion 115 for sealing fuel is formed by seating a valve body seat portion 101*b* of the valve body 101, and a fuel injection hole 116 through which fuel is injected on the downstream side of the seat portion 115 is formed.

The fuel injection valve 100 has a coil 108, and the coil 108 is sealed in a coil casing and is wound around a bobbin. The coil 108 is configured to be excited by a current that can be supplied via a terminal 105. The coil 108 and the terminal 105 are insulated by being covered by a connector mold 106 that can be coupled by injection molding.

In the fuel injection valve 100 according to the present embodiment, a magnetic circuit is constituted by a magnetic core 107 (fixed core), a mover group 200, the nozzle holder 111, and a yoke 109 (housing).

The fuel injection valve 100 has a first spring 210 on an inner diameter side of the magnetic core 107, and an adjuster pin 118 is disposed on the upstream side of the first spring 210. The adjuster pin 118 is engaged with the fuel supply port 112 formed in the magnetic core 107. A sleeve 117 is engaged with the valve body 101 on a side of the valve body 101 opposite to the seat member 102.

Figure 2:
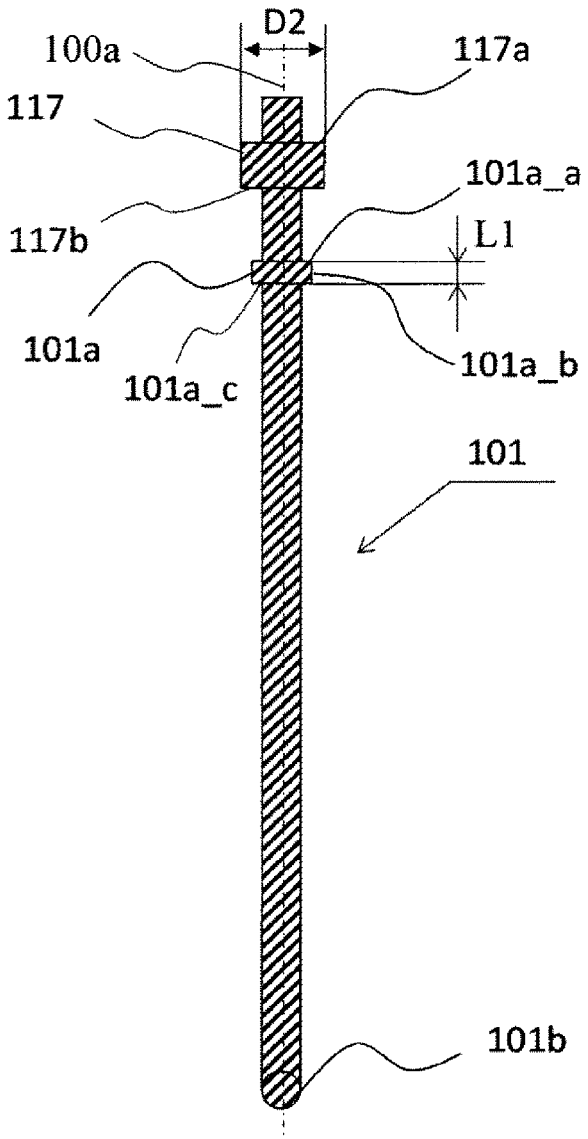
FIG. 2 is a cross-sectional view of a valve body of the fuel injection valve according to the embodiment of the present invention.

Here, as illustrated in FIG. 2, the valve body 101 has the sleeve 117 on the upstream side of a flange portion 101*a*. Accordingly, it is easy to attach a spacer 213 and a second spring 211 to be described below to the valve body 101. Details will be described with reference to FIG. 11.

The sleeve 117 has a first spring receiving surface 117*a* (FIG. 2) that receives an urging force of the first spring 210. The first spring 210 is compressed so as to be shorter than a natural length by the adjuster pin 118 and the first spring receiving surface 117*a*, and applies the urging force. The urging force of the first spring 210 acts in a direction to separate the valve body 101 and the adjuster pin 118. As a result, the first spring 210 urges the valve body 101 toward the seat member 102 via the sleeve 117.

Here, the first spring 210 urges the sleeve 117 in a valve closing direction.

The valve body 101 has the valve body seat portion 101*b* (seat portion) that, when the coil 108 is not energized, forms a seal seat by being pressed against the seat member 102 by the first spring 210 to come in contact with the seat portion 115, and thus, fuel is sealed.

The fuel injection hole 116 is formed on the downstream side of the valve body seat portion 101*b*, and when the valve body 101 separates from the seat member 102, the sealed fuel flows, and the fuel is injected from the fuel injection hole 116. A second spring receiving surface 117*b* (FIG. 2) for receiving an urging force of the second spring 211 is formed on a surface of the first spring receiving surface 117*a* of the sleeve 117 on the downstream side.

The valve body 101 has the spacer 213 (intermediate member), and the spacer 213 is configured to come into contact with the flange portion 101*a* provided on the valve body 101. The second spring 211 is housed between the spacer 213 and the sleeve 117, and the second spring 211 exerts the urging force in a direction to separate the sleeve 117 and the spacer 213. The spacer 213 is configured to be able to move relative to the valve body 101 in a direction of an axis 100*a*, and abuts on the flange portion 101*a* by the urging force of the second spring 211.

Here, as illustrated in FIG. 1, the valve body 101 has the flange portion 101*a* on the upstream side of a second mover 202. The spacer 213 is disposed between the sleeve 117 and the flange portion 101*a*. The sleeve 117 has a flange-like shape. Accordingly, the spacer 213 is not detached from the valve body 101. A material of the spacer 213 is, for example, non-magnetic stainless steel. The second spring 211 is disposed between the sleeve 117 and the spacer 213, and urges the spacer 213 toward the flange portion 101*a*.

The mover group 200 abuts on the magnetic core 107 on the upstream side. The nozzle holder 111 has a housing portion 111*a* for incorporating the mover group 200 on the downstream side of the magnetic core 107. The housing portion 111*a* contains a third spring 212 and the mover group 200, and the third spring 212 is disposed so as to abut on a third spring receiving surface 111*b*. The mover group 200 is disposed on a side opposite to a surface of the third spring 212 which abuts on the third spring receiving surface 111*b*, and the third spring 212 is housed so as to be interposed between the mover group 200 and the third spring receiving surface 111*b*.

Next, a positional relationship between the valve body 101, the mover group 200, and the spacer 213 in a state in which the coil 108 is not energized will be described with reference to FIGS. 2, 3, 4, 5, and 6.

The valve body 101 is urged in the valve closing direction by an urging force Fs of the first spring 210 via the sleeve 117. The second spring 211 is housed between the sleeve 117 and the spacer 213, and an urging force Fm of the second spring pushes the spacer 213 down in the valve closing direction. An urging force Fz of the third spring is transmitted to the spacer 213 via the mover group 200.

In the fuel injection valve 100 of the present embodiment, the springs are arranged such that the urging force Fz of the third spring 212 is smaller than the urging force Fm of the second spring 211. The spacer 213 is disposed so as to incorporate the valve body flange portion 101*a*, and the spacer 213 is supported by bringing a spacer contact surface 213*a* (spacer contact portion) into contact with a flange portion upper surface 101*a_a* (upper surface portion). The spacer 213 has a spacer sliding surface 213*b* on an inner diameter. The spacer sliding surface 213*b* comes in contact with a flange portion sliding surface 101*a_b*, and thus, a motion of the spacer sliding surface is restricted in a vertical direction along the axis 100*a*. That is, the spacer 213 is not shifted in a direction (horizontal direction) perpendicular to the axis 100*a*.

Figure 3:
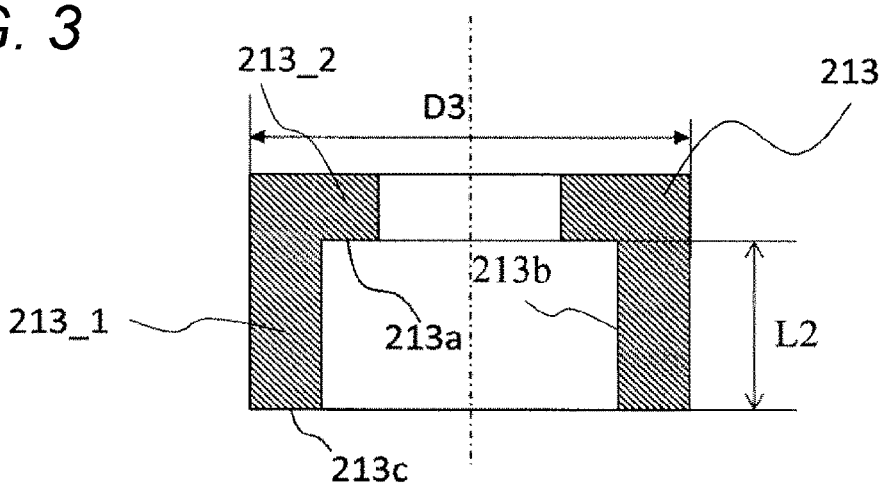
FIG. 3 is a cross-sectional view of a spacer of the fuel injection valve according to the embodiment of the present invention.
Figure 6:
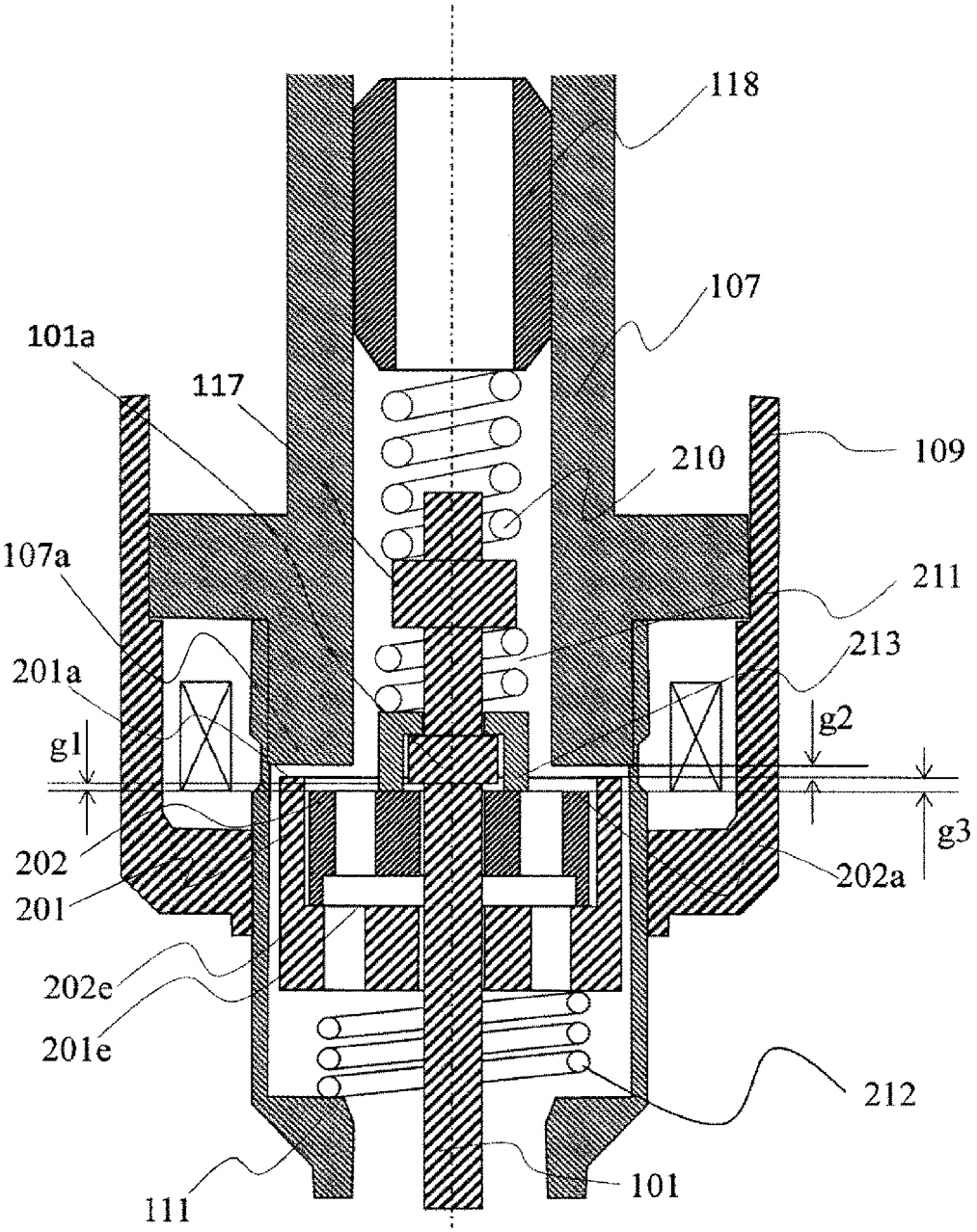
FIG. 6 is an enlarged view of a vicinity of a mover of the fuel injection valve according to the embodiment of the present invention, illustrates a state in which a coil is not energized.

Here, as illustrated in FIG. 3, the spacer 213 includes a cylindrical portion 213_1 and a disc-shaped portion 213_2 which is located on the upstream side of the cylindrical portion 213_1 and has a hole. The cylindrical portion 213_1 comes in contact with the second mover 202 in a valve closed state (FIG. 6). The cylindrical portion 213_1 forms a gap (void g1) in the axial direction between the flange portion 101*a* and the second mover 202 in the valve closed state (FIG. 6). The disc-shaped portion 213_2 is engaged with the flange portion 101*a* when the valve is closed.

In the valve closed state, the gap (void g1) in the axial direction between the flange portion 101*a* and the second mover 202 has a size of 10 to 100 μm (micrometer). In the valve closed state, the gap in the axial direction between the first mover 201 and the magnetic core 107 has a size of 20 μm to 190 μm. In the valve closed state, the gap in the axial direction between the second mover 202 and the magnetic core 107 has a size of 30 μm to 200 μm. Accordingly, the responsiveness of a valve opening operation in two stages (small stroke and large stroke) can be improved.

A mass of the first mover 201 and a mass of the second mover 202 are equivalent. Accordingly, the first mover 201 can absorb the impact when the second mover 202 collides with the flange portion 101*a* of the valve body 101 (during a preliminary operation). A second attraction area indicating an area of a portion of the second mover 202 abutting on the magnetic core 107 is larger than a first attraction area indicating an area of a portion of the first mover 201 abutting on the magnetic core 107. Accordingly, a magnetic attractive force acting on the second mover 202 is larger than a magnetic attractive force acting on the first mover 201.

A minimum inner diameter D1 (FIG. 1) of the fuel supply port 112 is larger than an outermost diameter D3 (FIG. 3) of the spacer 213 and an outermost diameter D2 (FIG. 2) of the valve body 101. That is, the outermost diameter D2 (FIG. 2) of the valve body 101 is smaller than the minimum inner diameter D1 (inner diameter, FIG. 1) of the magnetic core 107, and the outermost diameter D3 (FIG. 3) of the spacer 213 is smaller than the inner diameter F1 (inner diameter, FIG. 1) of the magnetic core 107. Here, an outer diameter of the flange portion 101*a* of the valve body 101 is smaller than the minimum inner diameter D1 (inner diameter) of the magnetic core 107.

Therefore, in an assembly stage of the fuel injection valve 100, since the valve body 101 and the spacer 213 are inserted in the latter half of an assembly process, even when foreign substances are mixed in, foreign substance discharge properties are improved, and contamination resistance can be improved.

A length relationship between a distance L2 (FIG. 3) between the spacer contact surface 213*a* and a spacer lower surface 213*c* and a distance L1 (FIG. 2) between the flange portion upper surface 101*a_a* and a flange portion lower surface 101*a_c* is established such that the distance L1 is shorter than the distance L2, and the spacer lower surface 213*c* protrudes toward the downstream side of the flange portion lower surface 101*a_c* in a state in which a current is not supplied to the coil 108. Therefore, the void g1 is formed between the mover group 200 and the flange portion 101*a* of the valve body 101 as illustrated in FIG. 6.

That is, as illustrated in FIG. 6, the spacer 213 forms the gap (void g1) in the axial direction between the flange portion 101*a* and the second mover 202 in the valve closed state. Accordingly, the valve can be opened by using the kinetic energy of the second mover 202.

Since the spring is disposed such that the urging force Fs of the first spring 210 is larger than the urging force Fz of the third spring 212, the valve body 101 and the seat member 102 (valve seat) abut on each other in a state in which the coil 108 is not energized.

The mover group 200 is divided into an outer first mover 201 and an inner second mover 202, and the first mover 201 incorporates the second mover 202. A second opposing surface 202*a* of the second mover 202 is disposed on the inner diameter side with respect to a first opposing surface 201*a* of the first mover 201. In other words, the first opposing surface 201*a* of the first mover 201 is disposed on the outer diameter side with respect to the second opposing surface 202*a* of the second mover 202. That is, an outer diameter of the first opposing surface 201*a* of the first mover 201 is smaller than an inner diameter of the second opposing surface 202*a* of the second mover 202, and the entire first opposing surface 201*a* of the first mover 201 is disposed on the inner diameter side of the second opposing surface 202*a* of the second mover 202.

An inner peripheral portion 201*b* of the first mover 201 is configured to face an outer peripheral portion 202*b* of the second mover 202 in a direction orthogonal to the axis 100*a* (valve body axis). That is, the inner peripheral portion 201*b* of the first mover 201 is configured to face the outer peripheral portion 202*b* of the second mover 202 in the horizontal direction a left-right direction in FIG. 5). Since the first mover 201 and the second mover 202 operate independently and separately, the inner peripheral portion 201*b* of the first mover 201 and the outer peripheral portion 202*b* of the second mover 202 are arranged with a gap in the horizontal direction.

An upstream side end surface 201*e* of the first mover 201 is configured to face a downstream side end surface 202*e* of the second mover 202 in the direction (up-down direction in FIG. 6) of the axis 100*a*.

As illustrated in FIG. 6, in the valve closed state in which any of the movers is not operating, the upstream side end surface 201*e* of the first mover 201 and the downstream side end surface 202*e* of the second mover 202 come in contact with each other.

The first mover 201 has a recess portion 201*c* that is recessed toward the downstream side on the inner diameter side, and incorporates the second mover 202 in the recess portion 201*c*. That is, the recess portion 201*c* of the first mover 201 is formed so as to be recessed toward the downstream side from the first opposing surface 201*a* on the inner diameter side with respect to the first opposing surface 201*a* formed on the outer diameter side.

The second mover 202 is disposed inside the recess portion 201*c*. Specifically, in the valve closed state in which any of the movers is not operating as illustrated in FIG. 6, the first opposing surface 201*a* of the first mover 201 is disposed on the upstream side of the second opposing surface 202*a* of the second mover 202. Therefore, the entire second mover 202 is configured to be located inside the recess portion 201*c* of the first mover 201.

Figure 4:
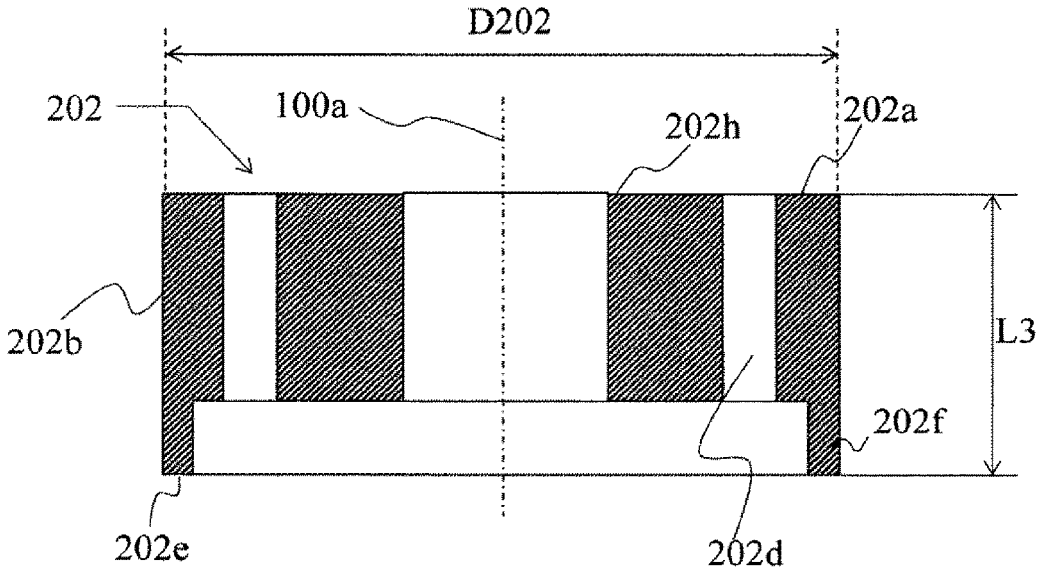
FIG. 4 is a cross-sectional view of a second mover of the fuel injection valve according to the embodiment of the present invention.
Figure 5:
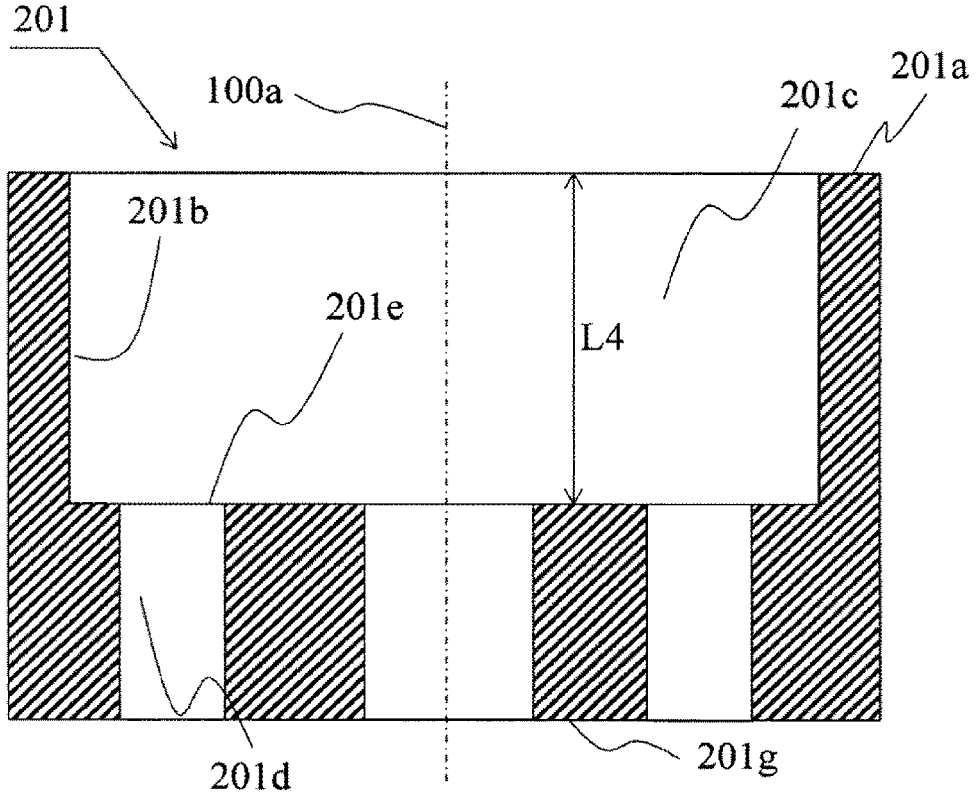
FIG. 5 is a cross-sectional view of a first mover of the fuel injection valve according to the embodiment of the present invention.

As illustrated in FIGS. 4 and 5, a length relationship between the first mover 201 and the second mover 202 in the axis 100*a* direction is established such that a maximum length L3 of the second mover 202 in the axial direction is longer than a maximum length L4 (depth) of the recess portion 201*c* of the first mover 201 in the axial direction. Therefore, as illustrated in FIG. 6, in a state in which the coil 108 is not energized, a void g3 which is a difference between the distance L4 of the first mover 201 and the distance L3 of the second mover 202 is formed, and a void g2 is formed between the first opposing surface 201*a* of the first mover 201 and a downstream side end surface 107*a* (collision surface) of the magnetic core 107.

The first mover 201 has a first engagement portion (upstream side end surface 201*e*) that is engaged with the second mover 202. When the first mover 201 moves to the upstream side, the first mover 201 and the second mover 202 are engaged by the first engagement portion (upstream side end surface 201*e*), and thus, the second mover 202 and the flange portion lower surface 101*a_c* are engaged with each other. Accordingly, the valve body 101 is moved to the upstream side (in a valve opening direction).

With these configurations, a magnetic attractive force acting on the first mover 201 drives the valve body 101 via the second mover 202, and a magnetic attractive force acting on the second mover 202 drives the valve body 101 via the flange portion lower surface 101*a_c* (that is, a flange contact surface).

Here, the first mover 201 is attracted to the magnetic core 107. As illustrated in FIG. 6, the second mover 202 is formed separately from the first mover 201, and is attracted to the magnetic core 107 on the inner diameter side of the first mover 201.

In order to reduce a fluid force generated during the movement, the first mover 201 and the second mover 202 have a first fuel passage hole 201*d* and a second fuel passage hole 202*d*, respectively. Areas of the hole portions of the first fuel passage hole 201*d* and the second fuel passage hole 202*d* in the vertical direction of the axis 100*a* are areas sufficient for reducing a fluid force due to an excluded volume when the first mover 201 (outer diameter side mover) and the second mover 202 (inner diameter side mover) operate.

It is desirable that the area of the first fuel passage hole 201*d* in the horizontal direction is larger than the area of the second fuel passage hole 202*d* in the horizontal direction. Although not illustrated, it is desirable that a plurality of first fuel passage holes 201*d* and a plurality of second fuel passage holes 202*d* are equally formed in order to secure the sufficient areas.

An outer diameter D202 of the outer peripheral portion 202*b* on the second opposing surface 202*a* (upstream side end surface) of the second mover 202 is larger than the minimum inner diameter F1 of the inner peripheral portion on the downstream side end surface 107*a* of the magnetic core 107. Therefore, when the coil 108 is energized, a magnetic flux is generated in the void between the second mover 202 having an attraction surface on the inner diameter side and the magnetic core 107 and the void between the first mover 201 having an attraction surface formed on the outer diameter side and the magnetic core 107, and the magnetic attractive forces are generated.

Next, an operation of each member when the drive current is supplied to the coil 108 will be described with reference to FIGS. 6 to 8.

As illustrated in FIG. 6, in a state in which the coil 108 is not energized, the sleeve 117 (engagement member) is urged by the first spring 210, and thus, the valve body seat portion 101*b* of the valve body 101 is in the valve closed state by coming in contact with the seat portion 115 of the seat member 102.

From the state of FIG. 6, when the drive current is supplied to the coil 108, the magnetic flux is generated in the magnetic core 107, the yoke 109, the first mover 201, and the second mover 202, and thus, the magnetic circuit is formed. Accordingly, the magnetic attractive forces are generated between the magnetic core 107 and the first mover 201 and between the magnetic core 107 and the second mover 202.

As illustrated in Inequality (1), when the sum of a magnetic attractive force Fi acting between the first mover 201 and the magnetic core 107 and a magnetic attractive force Fo acting between the second mover 202 and the magnetic core 107 is larger than a difference between the urging force Fm of the second spring 211 and the urging force Fz of the third spring 212, the first mover 201 and the second mover 202 are attracted to the magnetic core 107 side, and start to move.

[Inequality 1]

$$Fo+Fi>Fm-Fz \quad (1)$$

Figure 7:
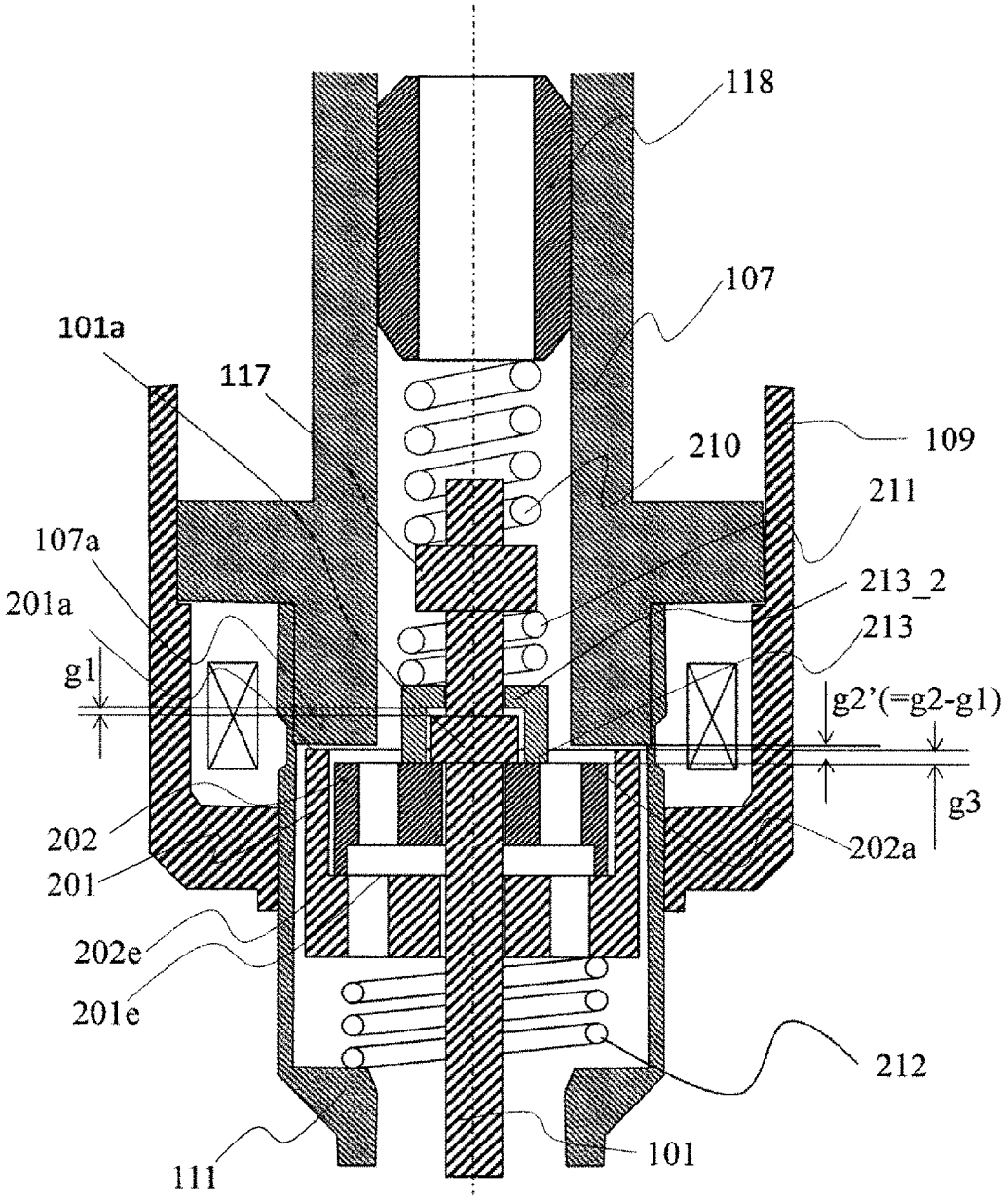
FIG. 7 shows a state in which the coil enters an energized state from a non-energized state of FIG. 6, the first mover and the second mover move in a valve opening direction, and a second opposing surface collides with a flange portion lower surface (collision surface).

When the first mover 201 and the second mover 202 are displaced by the void g1 between the flange portion 101*a* of the valve body 101 and the second mover 202 on the inner diameter side formed in advance by the spacer 213, the void formed between the downstream side end surface 107*a* of the magnetic core 107 and the second opposing surface 202*a* of the second mover 202 is g2 in FIG. 6, but is reduced to g2' in FIG. 7. A relationship of g2'−g2=g1 is established. The void g2' can be a clearance between the first opposing surface 201*a* of the first mover 201 and the downstream side end surface 107*a* of the magnetic core 107 in a state in which the second opposing surface 202*a* of the second mover 202 collides with the flange portion 101*a*.

In FIG. 7, the second opposing surface 202*a* of the second mover 202 on the inner diameter side collides with the flange portion lower surface 101*a_c* (collar contact surface) of the flange portion 101*a*. This void g1 is defined as a preliminary stroke. Since the kinetic energy stored in the first mover 201 and the second mover 202 is used for the valve opening operation of the valve body 101 by the void g1, it is possible to improve the responsiveness of the valve opening operation by the amount of used kinetic energy, and it is possible to open the valve even under a high fuel pressure. In order to secure the preliminary stroke, it is necessary to set a relationship of the void g2>the void g1 in the state of FIG. 6 in which the valve is closed.

Here, the flange portion 101*a* comes in contact with the second mover 202 in a valve opened state, and the gap (void g1) in the axial direction is formed between the flange portion 101*a* and the disc-shaped portion 213_2 of the spacer 213. The responsiveness of the valve closing operation is improved by the kinetic energy of the spacer 213.

Figure 8:
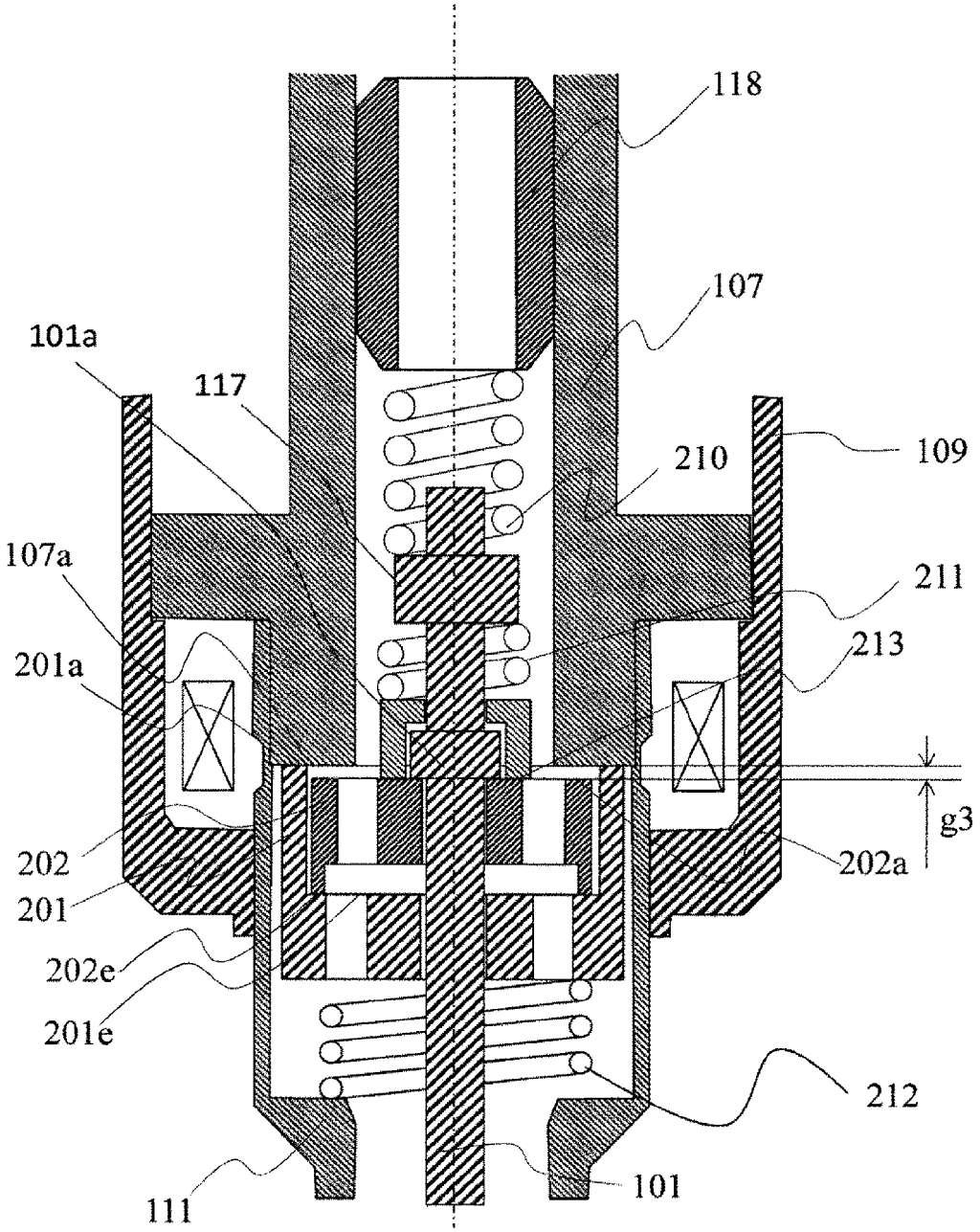
FIG. 8 illustrates a state in which the first mover is further displaced from the state of FIG. 7 and comes into contact with a first opposing surface and a downstream side end surface of a magnetic core.

When the energization of the coil 108 is continued and the mover group 200 is further displaced from the state of FIG. 7 by the void g2', the state illustrated in FIG. 8 is obtained. In FIG. 8, the displacement of the first mover 201 on the outer diameter side is restricted by the downstream side end surface 107*a* of the magnetic core 107.

Figure 10:
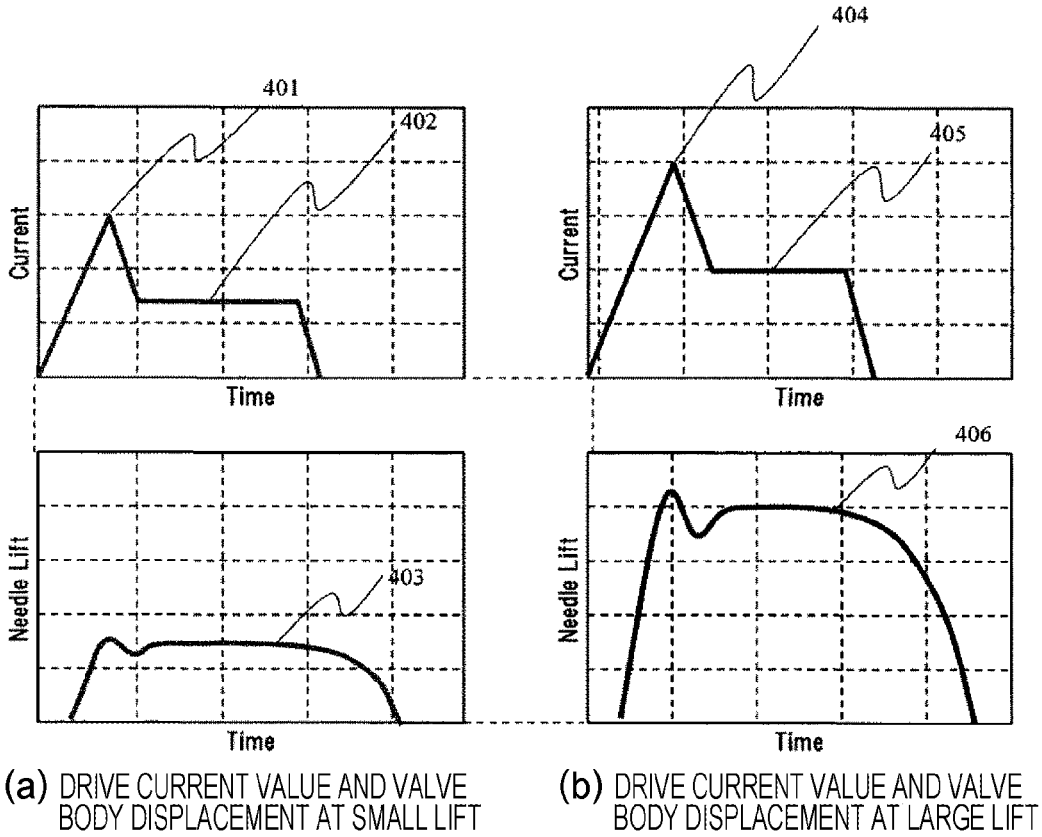
FIG. 10 is a diagram illustrating a drive current waveform and a valve body displacement of the fuel injection valve according to the embodiment of the present invention.

FIG. 10(*a*) illustrates a drive current waveform and a valve body displacement at a small stroke in the present embodiment, and FIG. 10(*b*) illustrates a drive current waveform and a valve body displacement at a large stroke.

Peak currents 401 and 404 are used to open the valve, and Holding currents 402 and 405 are used to hold the valve in the opened state.

First, a case where the peak current 401 of the drive current to be supplied to the coil 108 is smaller than a set value will be described as illustrated in FIG. 10(*a*).

In this case, the relationship between the forces of the following Inequality (2), that is, a condition in which the sum of the magnetic attractive force Fi of the second mover 202 and the magnetic attractive force Fo of the first mover 201 is larger than the sum of a differential pressure Fp caused by the fluid acting on the valve body 101 and the urging force Fs caused by the first spring 210 is satisfied. The relationship between the forces of the following Inequality (3), that is, a condition in which the magnetic attractive force Fi of the second mover 202 is smaller than the sum of the differential pressure Fp caused by the fluid acting on the valve body 101 and the urging force Fs caused by the first spring 210 is satisfied.

[Inequality 2]

$$Fs+Fp<Fi-Fo \quad (2)$$

[Inequality 3]

$$Fs+Fp>Fi \quad (3)$$

Therefore, Inequalities (2) and (3) are satisfied in the case of the current waveform of FIG. 10(*a*), and thus, the void (g2 of FIG. 6) between the first opposing surface 201*a* of the first mover 201 and the downstream side end surface 107*a* of the magnetic core 107 is eliminated as illustrated in FIG. 8. Only the void g3 between the second opposing surface 202*a* of the second mover 202 and the downstream side end surface 107*a* of the magnetic core 107 remains. That is, the valve body 101 is displaced by the magnetic attractive force Fo of the first mover 201 by Inequality (2), but the valve body 101 cannot be displaced only by the magnetic attractive force Fi of the second mover 202 by Inequality (3). Thus, the valve body is supported in a state in which the void g3 between the second opposing surface 202*a* of the second mover 202 and the downstream side end surface 107*a* of the magnetic core 107 remains.

From the state (small stroke state) of FIG. 8, as illustrated in FIG. 10(*a*), the magnetic flux generated between the magnetic core 107 and the first mover 201 on the outer diameter side and the second mover 202 on the inner diameter side disappears or is reduced by blocking the drive current to the coil 108 from the peak current or reducing the drive current to an intermediate current smaller than the peak current.

Accordingly, when the magnetic attractive force between these movers is smaller than the urging force of the first spring 210 and the fluid force acting on the valve body 101 by reducing the magnetic flux, the first mover 201 on the outer diameter side and the second mover 202 on the inner diameter side start to be displaced to the downstream side. Accordingly, the valve body 101 starts the valve closing operation, and then the valve body seat portion 101*b* of the valve body 101 collides with the seat portion 115 of the seat member 102. Accordingly, the valve is closed.

Therefore, in the case of the current waveform of FIG. 10(*a*), as illustrated in the lower diagram of FIG. 10(*a*), the valve body 101 is displaced by the valve body displacement amount provided between the first opposing surface 201*a* of the first mover 201 and the downstream side end surface 107*a* of the magnetic core 107. This valve body displacement corresponds to the void g2' illustrated in FIG. 7.

As for the displacement of the first mover 201, the first mover collides with the downstream side end surface 107*a* of the magnetic core 107 or a member different from the magnetic core 107, and thus, the movement of the first mover 201 in the axial direction is restricted. Thus, since the amount of displacement of the valve body 101 is stabilized, a stable injection amount can be supplied.

Meanwhile, a case where the peak current 404 of the drive current to be supplied to the coil 108 is larger than a preset value as illustrated in FIG. 10(*b*) will be described. That is, when the valve body 101 is driven at a large stroke, the peak current 404 is larger than the peak current 401 in the case of the small stroke of FIG. 10(*a*). In this case, as represented in Inequality (4), the magnetic attractive force Fi of the second mover 202 on the inner diameter side is larger than the sum of the differential pressure Fp caused by the fluid acting on the valve body 101 and the urging force Fs caused by the first spring 210.

Figure 9:
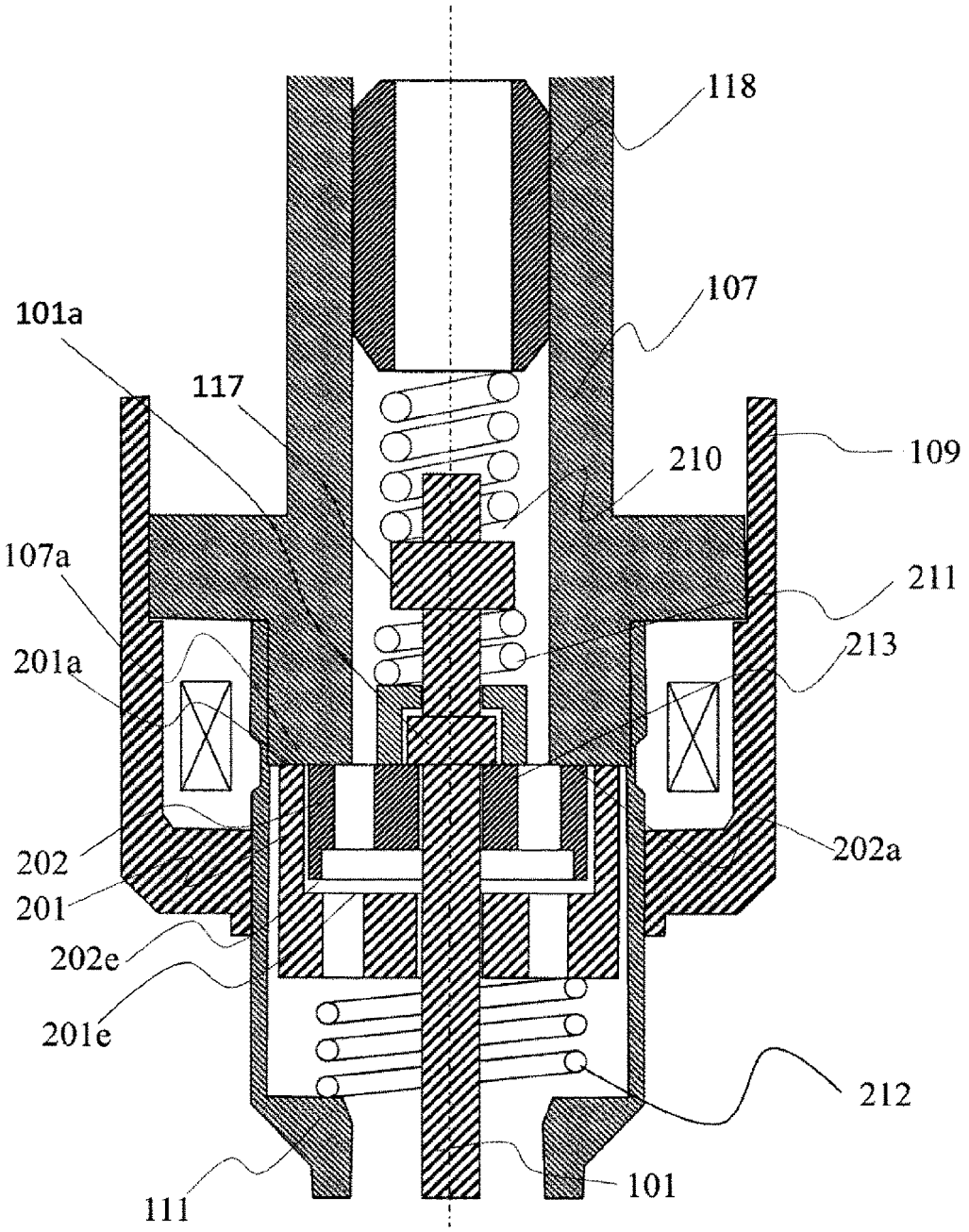
FIG. 9 illustrates a state in which only the second mover is further displaced from the state of FIG. 8 and the second opposing surface comes in contact with the downstream side end surface of the magnetic core.

Accordingly, as illustrated in FIG. 9, the second mover 202 on the inner diameter side is displaced in the upstream direction by the void g3 formed between the downstream side end surface 107*a* of the magnetic core 107 and the second opposing surface 202*a* of the second mover 202 in FIG. 8. That is, the void g3 is a clearance between the second opposing surface 202*a* of the second mover 202 and the downstream side end surface 107*a* of the magnetic core 107 in a state in which the first opposing surface 201*a* of the first mover 201 collides with the downstream side end surface 107*a* of the magnetic core 107. As a result, since the second mover 202 further raises the valve body 101 from the state of FIG. 7 by the void g3, the valve body 101 is displaced in total by the sum of the void g2' and the void g3. This displacement is called a large stroke.

The displacement of the second mover 202 is restricted by colliding with the magnetic core 107 or a fixed member different from the magnetic core 107. Therefore, since the behavior of the valve body 101 is stabilized, the stable injection amount can be supplied.

[Inequality 4]

$$Fs+Fp<Fi \quad (4)$$

The drive current to the coil 108 is blocked from the peak current 404 or is reduced to the intermediate current smaller than the peak current 404 from the state of FIG. 9 at the large stroke. Accordingly, the magnetic flux generated between the second mover 202 on the inner diameter side and the magnetic core 107 disappears or is reduced. When the magnetic attractive force between these movers is smaller than the urging force of the first spring 210 and the fluid force acting on the valve body 101, the second mover 202 is displaced to the downstream side.

The magnetic flux starts to disappear from the second mover 202 on the inner diameter side, and the second mover 202 performs the valve closing operation earlier than the first mover 201 by the fluid force and the urging force of the first spring 210. As a result, the second mover 202 on the inner diameter side is displaced to the downstream side by the void g3 between the upstream side end surface 201*e* of the first mover 201 and the downstream side end surface 202*e* of the second mover 202, and collides with the upstream side end surface 201*e* of the first mover 201. The first mover 201 is also displaced to the downstream side due to the collision with the second mover 202.

Along with these motions, the valve body 101 starts the valve closing operation, and then the valve body seat portion 101*b* collides with the seat portion 115 of the seat member 102. Accordingly, the valve is closed. As a result, as illustrated in FIG. 10(*b*), the valve body 101 has a large stroke, and the displacement amount is denoted by 406. The valve body displacement 406 which is this displacement amount corresponds to the sum of the void g2' and the void g3.

In the present embodiment, the displacement of the valve body 101 can be switched between the small stroke of FIG. 10(*a*) and the large stroke of FIG. 10(*b*) by the drive current to be supplied to the coil 108 of the fuel injection valve 100. In the valve closed state, a first clearance (void g2'+void g3 or void g2+void g3) between the second opposing surface 202*a* of the second mover 202 and the magnetic core 107 is larger than a second clearance (void g2' or void g2) between the first opposing surface 201*a* of the first mover 201 and the magnetic core 107.

Here, the void g1 is defined as a clearance between the second opposing surface 202*a* of the second mover 202 and the flange portion 101*a* of the valve body 101 in the valve closed state as illustrated in FIG. 6. The void g2 is defined as a clearance between the first opposing surface 201*a* of the first mover 201 and the downstream side end surface 107*a* of the magnetic core 107 in the valve closed state as illustrated in FIG. 6. As illustrated in FIG. 8, the void g3 is defined as a clearance between the second opposing surface 202*a* of the second mover 202 and the downstream side end surface 107*a* of the magnetic core 107 in a state in which the first opposing surface 201*a* of the first mover 201 collides with the downstream side end surface 107*a* of the magnetic core 107.

Here, when the displacement of the valve body 101 is switched between the small stroke of FIG. 10(*a*) and the large stroke of FIG. 10(*b*) by the drive current as described above, it is desirable that the void g3>the void g2. Since the void g2 is used for adjusting the displacement of the valve body when the fuel injection valve 100 is assembled, the void (stroke) can be accurately set. In the present embodiment, when the seat member 102 against which the valve body 101 is pressed is press-fitted into the nozzle holder 111, the stroke amount of the void g2' is adjusted by adjusting the press-fit amount. Although it has been described in the present embodiment that the press-fit amount between the seat member 102 and the nozzle holder 111 is adjusted, the present invention is not limited thereto.

Meanwhile, as illustrated in FIG. 8, the void g3 is the clearance between the second opposing surface 202*a* of the second mover 202 and the downstream side end surface 107*a* of the magnetic core 107 in a state in which the first opposing surface 201*a* of the first mover 201 collides with the downstream side end surface 107*a* of the magnetic core 107, the stroke amount cannot be adjusted unlike the void g2'. Therefore, it is desirable that the void g3 which decides the large stroke amount is large in consideration of a component tolerance. In the present embodiment, the void g2' and the void g1 for deciding the preliminary stroke amount are set to be substantially equal to each other, or to have the relationship of void g3>void g1.

In this manner, the displacement of the valve body 101 can be variable by dividing the mover group 200 into the first mover 201 and the second mover 202 and changing the drive current to be supplied to the coil 108. Injection amount characteristics due to the valve body displacement 406 at the large stroke and injection amount characteristics due to the valve body displacement 403 at the small stroke are obtained by changing the current waveform according to a required flow rate as illustrated in FIG. 10. Therefore, it is possible to stably supply an optimum fuel injection amount required for the combustion of an internal combustion engine by using the injection amount characteristics at the large stroke when the required flow rate is large and conversely using the injection amount characteristics at the small stroke when the required flow rate is small.

In the present embodiment, an intake air amount, an internal combustion engine speed, a fuel injection pressure, and an accelerator opening degree are sensed, and the current waveform of the drive current to be supplied to the coil 108 of the fuel injection valve is switched according to a threshold value. However, the present invention is not limited thereto, and similar effects are obtained by performing switching by using other information as needed.

Figure 11:
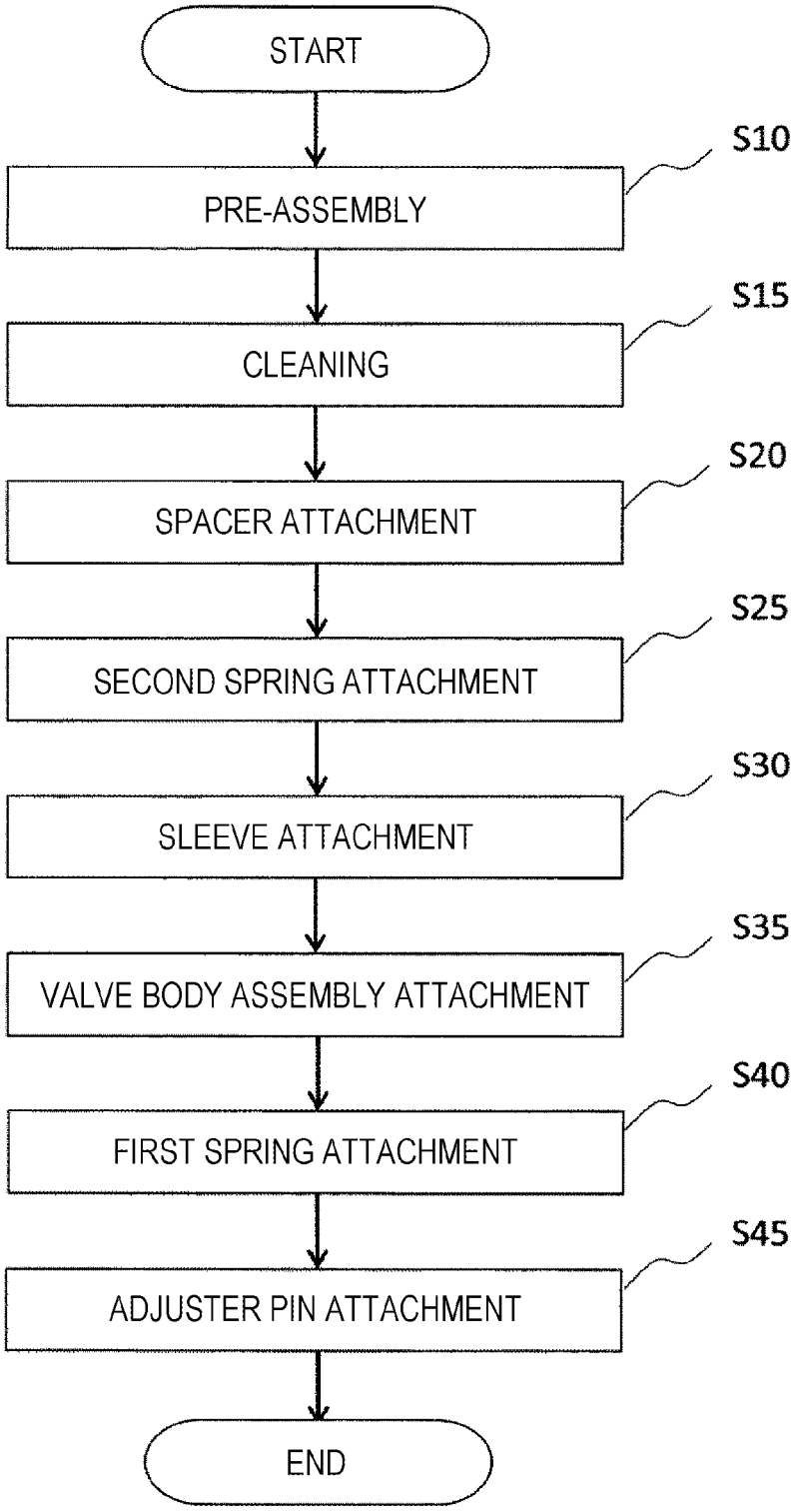
FIG. 11 is a flowchart of a method for assembling the fuel injection valve according to the embodiment of the present invention.

Next, a method for assembling the fuel injection valve will be described. FIG. 11 is a flowchart of the method (producing method) of assembling the fuel injection valve according to the embodiment of the present invention.

First, pre-assembly is performed (S10). Specifically, components other than the valve body 101, the spacer 213, the second spring 211, the sleeve 117, the first spring 210, and the adjuster pin 118 are assembled in the same manner as in the related art.

The inside of the assembly assembled in S10 is cleaned (S15). Accordingly, foreign substances such as resin pieces and metal pieces can be discharged. A root (head) of the valve body 101 having the flange portion 101*a* is inserted into the hole of the spacer 213 (S20). The root of the valve body 101 is inserted into the second spring 211 (S25). The sleeve 117 having a flange-like shape is engaged with the root of the valve body 101 (S30).

A valve body assembly (assembly) including the valve body 101, the spacer 213, the second spring 211, and the sleeve 117 is inserted into the fuel supply port 112 (hole) of the magnetic core 107 (S35). The first spring 210 is inserted into the fuel supply port 112 (hole) of the magnetic core 107 (S40). The adjuster pin 118 is engaged with the fuel supply port 112 (hole) (S45).

Accordingly, the foreign substance discharge properties are improved, and the contamination resistance can be improved.

As described above, according to the present embodiment, a control range of the fuel injection amount is widened by configuring a plurality of strokes. In the valve closed state, it is possible to stroke the valve body in two stages of the large and small strokes by the void formed between the mover and the valve body or the component engaged with the valve body, and it is possible to provide the fuel injection valve capable of accurately controlling the injection flow rate at this time. The kinetic energy of the mover can be used for the valve opening operation, and the optimal fuel injection can be realized in a wide operating range of the internal combustion engine.

As described above, according to the present embodiment, the valve body can be stroked in two stages of the large and small strokes, and the responsiveness of the valve opening operation can be improved.

The present invention is not limited to the aforementioned embodiments, and includes various modification examples.

For example, the aforementioned embodiments are described in detail in order to facilitate easy understanding of the present invention, and are not limited to necessarily include all the described components.

For example, the embodiment of the present invention may have the following aspects.

(1) The fuel injection valve includes the first mover 201 attracted to the magnetic core 107, the second mover 202 that is formed separately from the first mover 201, and is attracted to the magnetic core 107 on the inner diameter side of the first mover 201, and the spacer 213 that forms the gap in the axial direction between the valve body 101 and the second mover 202 by being engaged with the valve body 101 and the second mover 202 in the valve closed state.

(2) In the fuel injection valve, the outermost diameter portion (outermost diameter D3) of the spacer 213 and the outermost diameter portion (outermost diameter D2) of the valve body 101 are located on the inner diameter side of the innermost diameter portion (minimum inner diameter D1) of the magnetic core 107.

(3) The fuel injection valve includes the first spring (first spring 210) that urges the valve body 101 in the valve closing direction, and the second spring (second spring 211) that is supported by the valve body 101 or a separate member integrated with the valve body 101, and urges the spacer 213 toward the second mover 202.

(4) In the fuel injection valve, the valve body 101 is operated in the valve opening direction by inserting the valve body 101 into a first insertion hole formed on the inner diameter side of the first mover 201 and a second insertion hole formed on the inner diameter side of the second mover 202 and engaging a mover engagement portion 202*h* on the outer diameter side of the second insertion hole with a valve body engagement portion (flange portion 101*a*).

(5) In the fuel injection valve, the outermost diameter portion of the valve body engagement portion (flange portion 101*a*) is located on the inner diameter side of the innermost diameter portion (minimum inner diameter D1) of the magnetic core 107.

REFERENCE SIGNS LIST

100 fuel injection valve
100*a* axis
101 valve body
101*a* flange portion
101*a_a* flange portion upper surface
101*a_b* flange portion sliding surface
101*a_c* flange portion lower surface
101*b* valve body seat portion
102 seat member
105 terminal
106 connector mold
107 magnetic core
107*a* downstream side end surface
108 coil
109 yoke
111 nozzle holder
111*a* housing portion
111*b* third spring receiving surface
112 fuel supply port
112*a* fuel inlet surface
115 seat portion
116 fuel injection hole
117 sleeve
117*a* first spring receiving surface
117*b* second spring receiving surface
118 adjuster pin
122 communication line
123 signal line
200 mover group
201 first mover
201*a* first opposing surface
201*b* inner peripheral portion
201*c* recess portion
201*d* first fuel passage hole
201*e* upstream side end surface
202 second mover
202*a* second opposing surface
202*b* outer peripheral portion
202*d* second fuel passage hole
202*e* downstream side end surface
210 first spring
211 second spring
212 third spring
213 spacer
213*a* spacer contact surface
213*b* spacer sliding surface
213*c* spacer lower surface
401 peak current
403 valve body displacement
404 peak current
406 valve body displacement

The invention claimed is:

1. A fuel injection valve comprising:

a first mover that is attracted to a magnetic core, the first mover being configured to store kinetic energy therewithin;

a second mover that is formed separately from the first mover, and is attracted to the magnetic core on an inner diameter side of the first mover;

a valve body comprising a flange portion disposed above the second mover;

a spacer disposed above the second mover, the spacer forming a gap in an axial direction between the flange portion and the second mover in a valve closed state, the spacer having a hole;

a first spring that urges a sleeve of the valve body in a valve closing direction; and a second spring that is disposed between the sleeve and the spacer, and urges the spacer toward the flange portion, wherein a head of the valve body having the flange portion is configured to be inserted into the hole of the spacer, and wherein the first mover and the second mover are positioned upstream of the magnetic core, and a third spring is positioned downstream of the magnetic core, the third spring having a smaller urging force than an urging force of the second spring, the urging force of the second spring being smaller than an urging force of the first spring.

2. The fuel injection valve according to claim 1, wherein an outermost diameter of the valve body is smaller than an inner diameter of the magnetic core, and an outermost diameter of the spacer is smaller than the inner diameter of the magnetic core.

3. The fuel injection valve according to claim 1, wherein the sleeve is on an upstream side of the flange portion, and the spacer is disposed between the sleeve and the flange portion.

4. The fuel injection valve according to claim 1, wherein the spacer includes a cylindrical portion, and a disc-shaped portion that is disposed on an upstream side of the cylindrical portion, and has the hole of the spacer.

5. The fuel injection valve according to claim 4, wherein the cylindrical portion comes in contact with the second mover in the valve closed state.

6. The fuel injection valve according to claim 5, wherein the flange portion comes in contact with the second mover in a valve opened state, and a gap in an axial direction is formed between the flange portion and the disc-shaped portion.

7. The fuel injection valve according to claim 1, wherein the gap in the axial direction between the flange portion and the second mover in the valve closed state is 10 to 100 um.

8. The fuel injection valve according to claim 1, wherein a gap in the axial direction between the first mover and the magnetic core in the valve closed state is 20 um to 190 um.

9. The fuel injection valve according to claim 1, wherein a gap in the axial direction between the second mover and the magnetic core in the valve closed state is 30 um to 200 um.

10. The fuel injection valve according to claim 1, wherein a mass of the first mover and a mass of the second mover are equal.

11. The fuel injection valve according to claim 1, wherein a second attraction area indicating an area of a portion of the second mover abutting on the magnetic core is larger than a first attraction area indicating an area of a portion of the first mover abutting on the magnetic core.

12. The fuel injection valve according to claim 2, wherein an outer diameter of the flange portion is smaller than the inner diameter of the magnetic core.

13. The fuel injection valve according to claim 3, wherein the sleeve has a flange-like shape.

14. A method for assembling a fuel injection valve, comprising:

a step of inserting a root of a valve body having a flange portion into a hole of a spacer, wherein the flange portion is disposed below the spacer;

a step of inserting the root of the valve body into a second spring;

a step of engaging a sleeve having a flange-like shape with the root of the valve body;

a step of inserting an assembly including the valve body, the spacer, the spring, and the sleeve into a hole of a magnetic core;

a step of inserting a first spring into the hole of the magnetic core;

a step of engaging an adjuster pin with the hole of the magnetic core, wherein a third spring is arranged on a downstream side of the magnetic core, the third spring having a smaller urging force than an urging force of the second spring, the urging force of the second spring being smaller than an urging force of the first spring;

a step of engaging a second mover around the valve body, the second mover disposed below the flange portion and the spacer; and a step of engaging a first mover around the valve body, the first mover disposed below the second mover.

* * * * *